US011566358B2

(12) United States Patent
Kambara et al.

(10) Patent No.: US 11,566,358 B2
(45) Date of Patent: Jan. 31, 2023

(54) NEEDLE PLATE AND SEWING MACHINE INCLUDING SAME

(71) Applicant: JANOME SEWING MACHINE CO., LTD., Tokyo (JP)

(72) Inventors: Yumiko Kambara, Tokyo (JP); Yoshitaka Bamba, Tokyo (JP); Jun Mafune, Tokyo (JP)

(73) Assignee: JANOME SEWING MACHINE CO., LTD., Tokyo (JP)

( * ) Notice: Subject to any disclaimer, the term of this patent is extended or adjusted under 35 U.S.C. 154(b) by 69 days.

(21) Appl. No.: 16/951,731

(22) Filed: Nov. 18, 2020

(65) Prior Publication Data

US 2021/0246588 A1 Aug. 12, 2021

(30) Foreign Application Priority Data

Feb. 7, 2020 (JP) ..... JP2020-019496

(51) Int. Cl.
*D05B 73/12* (2006.01)
*D05B 37/04* (2006.01)

(52) U.S. Cl.
CPC ..... *D05B 73/12* (2013.01); *D05B 37/04* (2013.01)

(58) Field of Classification Search
CPC ..... D05B 73/12; D05B 37/063; D05B 37/08
See application file for complete search history.

(56) References Cited

U.S. PATENT DOCUMENTS 139,350 A * 5/1873 Allen ..... D05B 37/04 112/128
660,617 A * 10/1900 Bissinger ..... D05B 37/04 112/128
3,313,259 A * 4/1967 Daniel et al. ..... D05B 73/12 112/260
3,765,350 A * 10/1973 Sztari ..... D05B 37/063 112/122
4,353,158 A * 10/1982 Henshaw ..... D04H 18/02 112/152
4,969,409 A * 11/1990 Nakano ..... D05B 73/12 112/260
9,303,345 B2 4/2016 Hasegawa et al.
2001/0039907 A1* 11/2001 Hayashi ..... D05B 27/08 112/312
2005/0211145 A1* 9/2005 Sakuma ..... D05B 73/12 112/302

(Continued)

FOREIGN PATENT DOCUMENTS

JP 2014-195491 A 10/2014

*Primary Examiner* — Nathan E Durham
(74) *Attorney, Agent, or Firm* — Nakanishi IP Associates, LLC

(57) ABSTRACT

In a needle plate, a needle plate hole is configured to include a hole-side cutting side that cuts a cutting target object together with a blade portion, and a relief side that allows a cut portion of the cutting target object to escape. Specifically, the needle plate hole has the hole-side cutting side that shears the cutting target object together with a blade-side cutting side of the blade portion, and the relief side that forms a gap between the blade portion to be inserted and the relief side. In this manner, in the former stage of cutting processing, the cutting target object can be cut by the hole-side cutting side and the blade-side cutting side.

4 Claims, 6 Drawing Sheets

(56) References Cited

U.S. PATENT DOCUMENTS

| | | | | |
|---|---|---|---|---|
| 2010/0175601 | A1* | 7/2010 | Fukao | D05B 73/12 112/260 |
| 2010/0192824 | A1* | 8/2010 | Matsumoto | D05B 21/007 112/260 |
| 2014/0290547 | A1 | 10/2014 | Hasegawa et al. | |
| 2014/0290550 | A1* | 10/2014 | Hasegawa | D05B 37/08 112/470.05 |

* cited by examiner

NEEDLE PLATE AND SEWING MACHINE INCLUDING SAME

CROSS REFERENCE TO RELATED APPLICATION

This application claims priority to Japanese Patent Application No. 2020-019496 filed on Feb. 7, 2020, the entire content of which is incorporated by reference.

BACKGROUND OF THE INVENTION

Field of the Invention

The invention relates to a needle plate and a sewing machine including the same.

Background Art

JP-A-2014-195491 discloses a sewing machine that can form a patent or the like on a cutting target object (cloth) by cutting the cutting target object. Specifically, a cutting needle rotation device is provided on a lower end portion of a needle bar, a cutting needle (cutwork blade) of the cutting needle rotation device is arranged coaxially with the needle bar, and is configured to be rotatable around the axis of the needle bar. Further, a needle plate is provided below the cutting needle rotation device, and a needle plate hole is formed in the needle plate. The cutting needle is lowered together with the needle bar so that a blade portion of the cutting needle is inserted into the needle plate hole, and thereby the cutting target object is cut by the blade portion and the needle plate hole.

SUMMARY OF THE INVENTION

However, in the sewing machine in JP-A-2014-195491, there is room for improvement in the following points. That is, in the above-described sewing machine, since the cutting needle is rotated around the axis of the needle bar, the direction of the cutting needle is changed according to the rotation position of the cutting needle. In JP-A-2014-195491, the shape of the needle plate hole is not particularly mentioned, but generally, the needle plate hole is formed in a circular shape in order to cope with the change of the direction of the cutting needle. Therefore, when the cutting target object is cut, the cutting target object may be torn off, and the surface cut in the cut portion may be formed to be a rough surface. In this manner, in the above-described sewing machine, there is room for improvement in improving the finish of the cut portion.

An object of the invention is to provide a sewing machine which can improving the finish of the cut portion in consideration of the above circumstances.

One or more embodiments of the invention are a needle plate of a sewing machine, and the needle plate includes a needle plate body provided below a needle bar that is moved up and down; and a needle plate hole which is formed in the needle plate body, and into which a blade portion of a cutwork blade attached to a lower end portion of the needle bar is inserted, in which the needle plate hole includes a hole-side cutting side which cuts a cutting target object together with the blade portion, and a relief portion which allows the cutting target object that has been cut to escape.

One or more embodiments of the invention are the needle plate in which, when the blade portion is inserted into the needle plate hole, a gap through which the cutting target object is able to pass is formed by the cutwork blade and the relief portion.

One or more embodiments of the invention are the needle plate in which the blade portion has a blade-side cutting side that cuts the cutting target object together with the hole-side cutting side, the blade-side cutting side is formed linearly when seen from an axial direction of the needle bar, the hole-side cutting side has a linear shape corresponding to the blade-side cutting side, and the relief portion has a curved shape.

One or more embodiments of the invention are the needle plate in which the blade portion has a blade-side cutting side that cuts the cutting target object together with the hole-side cutting side, the needle plate hole is formed in a polygonal shape configured by a plurality of sides having the same shape as the blade-side cutting side, the hole-side cutting side is configured by one side of the needle plate hole, and the relief portion is configured by remaining sides of the plurality of sides of the needle plate hole.

One or more embodiments of the invention are a sewing machine including the needle plate having the above-described configuration.

According to the needle plate and the sewing machine having the above-described configuration, the finish of the cut portion can be improved.

DETAILED DESCRIPTION OF THE INVENTION

First Embodiment

Figure 1:
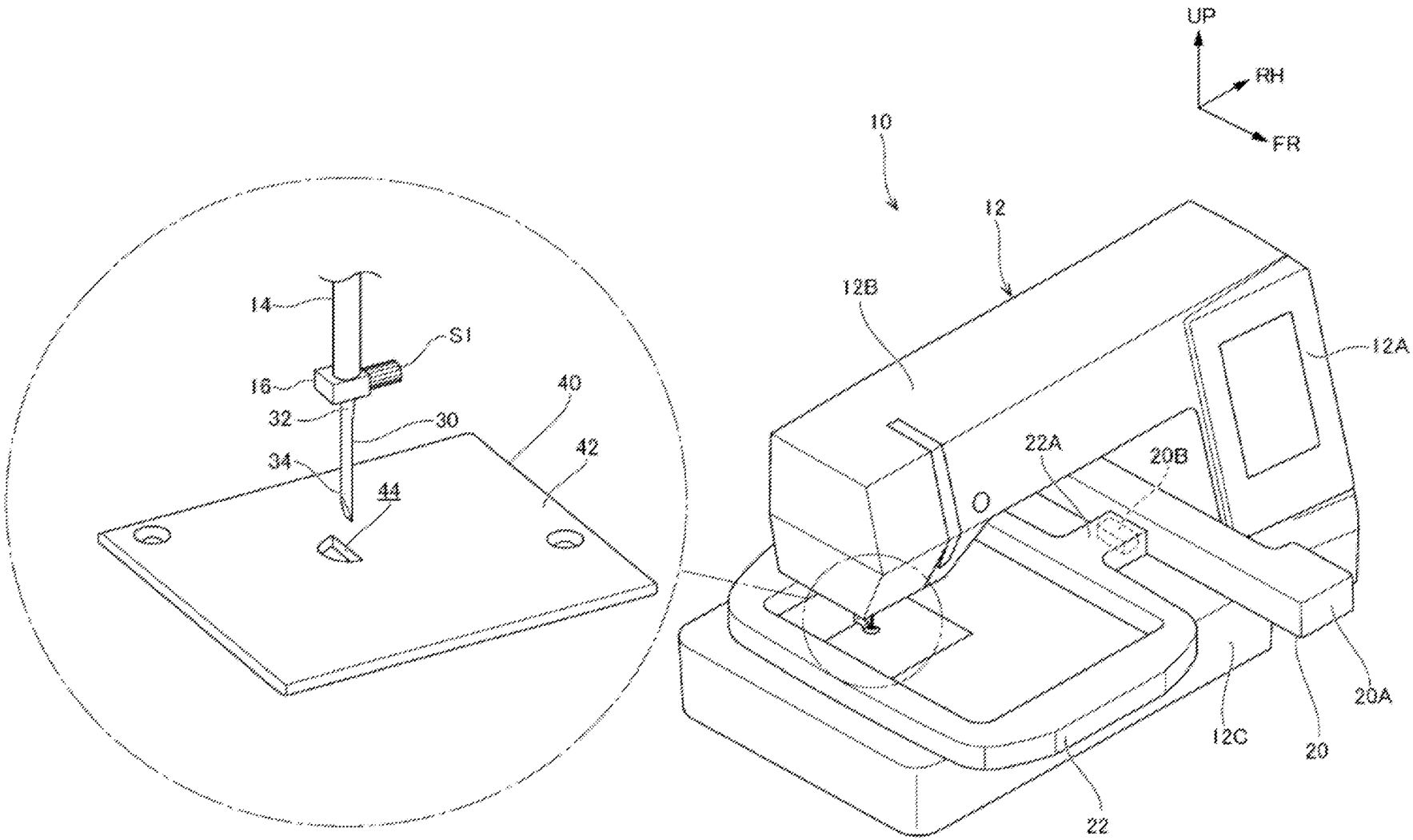
FIG. 1 is a perspective view illustrating a sewing machine to which a needle plate according to a first embodiment is applied, which is seen diagonally from the front left.

Hereinafter, a sewing machine 10 to which a needle plate 40 according to a first embodiment is applied will be described using FIGS. 1 to 3B. Arrows UP, FR, and RH appropriately illustrated in the drawings indicate the upper side, the front side, and the right side (one side in a width direction) of the sewing machine 10, respectively. Hereinafter, in a case where description is made using the up-down direction, the front-rear direction, and the left-right direction, those directions indicate the up and down, the front and rear, and the left and right of the sewing machine 10.

Regarding Entire Sewing Machine 10

As illustrated in FIG. 1, the sewing machine 10 has a sewing machine body 12, and the sewing machine body 12 is formed in a substantially U shape open leftward in a front view seen from the front side. Specifically, the sewing machine body 12 is configured to include a pillar portion 12A that constitutes a right end portion of the sewing machine body 12 and extends in the up-down direction, an arm portion 12B that extends to the left side from the upper end portion of the pillar portion 12A, and a bed portion 12C that extends to the left side from the lower end portion of the pillar portion 12A.

The left end portion of the arm portion 12B is provided with a needle bar 14. The needle bar 14 is formed in a substantially columnar shape of which the axial direction is the up-down direction, and is supported, inside the arm portion 12B, by the sewing machine body 12. The lower end portion of the needle bar 14 protrudes downward from the arm portion 12B, and a needle bar fixing portion 16 for fixing a cutwork blade 30 which will be described later is provided on the lower end portion of the needle bar 14. A fixing hole (not illustrated) is formed in the needle bar fixing portion 16, and the fixing hole is open downward, and is formed to have a substantially D-shaped cross section. Further, the needle bar 14 is connected to a needle bar drive mechanism (not illustrated), and the needle bar 14 is moved in the up-down direction in a reciprocating manner by the needle bar drive mechanism during the operation of the sewing machine 10.

The sewing machine 10 is configured as a sewing machine that can perform cutting on a cutting target object 50 (refer to FIGS. 3A and 3B) such as cloth. Specifically, the sewing machine 10 has an embroidery frame drive device 20, an embroidery frame 22, the cutwork blade 30, and the needle plate 40 which are used during cutting. Hereinafter, each configuration of the sewing machine 10 used during cutting will be described.

Regarding Embroidery Frame Drive Device 20

The embroidery frame drive device 20 is detachably mounted on the bed portion 12C of the sewing machine body 12. The embroidery frame drive device 20 is configured to include a drive arm 20A and a carriage 20B. The drive arm 20A is formed in a substantially rectangular parallelepiped shape extending in the front-rear direction, and is configured to be movable in the left-right direction, on a side above the bed portion 12C. The carriage 20B is provided on the drive arm 20A so as to be movable in the front-rear direction. The drive arm 20A and the carriage 20B are configured to be moved by a drive unit (not illustrated) of the embroidery frame drive device 20.

Regarding Embroidery Frame 22

The embroidery frame 22 is formed in a substantially rectangular frame shape. An embroidery frame fixing portion 22A protruding rightward is formed on the right outer circumferential portion of the embroidery frame 22, and the embroidery frame fixing portion 22A is fixed to the carriage 20B of the embroidery frame drive device 20. In this manner, the embroidery frame 22 is configured to be moved in the front-rear and left-right directions, on a side below the needle bar 14, by driving the embroidery frame drive device 20. In addition, the embroidery frame 22 is configured by two members, and the embroidery frame 22 is configured to vertically sandwich the cutting target object 50. In this manner, the cutting target object 50 is configured to be movable in the front-rear and left-right directions together with the embroidery frame 22, on a side below the needle bar 14 and above the bed portion 12C.

Regarding Cutwork Blade 30

The cutwork blade 30 is formed in a substantially bar shape of which the axial direction is the up-down direction. The upper portion of the cutwork blade 30 is configured as a blade-side fixing portion 32, and the blade-side fixing portion 32 is formed in a substantially D shape corresponding to the fixing hole of the needle bar fixing portion 16 in a plan view. The blade-side fixing portion 32 is fitted into the fixing hole of the needle bar fixing portion 16 from below, and is fixed to the needle bar fixing portion 16 by a fixing screw S1.

Figure 2:
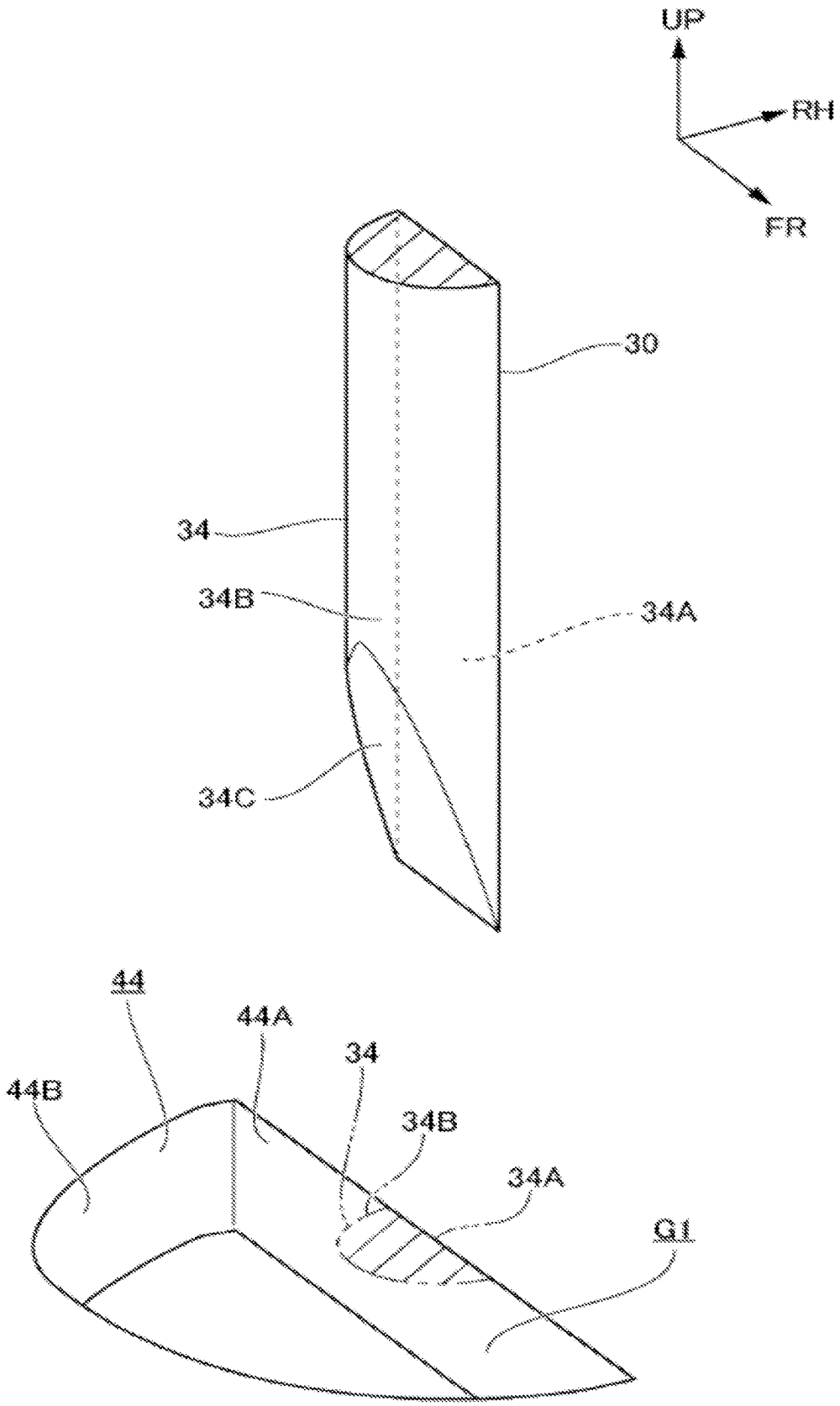
FIG. 2 is a perspective view illustrating a blade portion of a cutwork blade and a needle plate hole illustrated in FIG. 1 in an enlarged manner.

As illustrated in FIG. 2, the lower portion of the cutwork blade 30 is configured as a blade portion 34 for cutting the cutting target object 50. The blade portion is formed in a substantially D shape when seen from below. Specifically, the outer circumferential portion of the blade portion 34 is configured to include a blade-side cutting side 34A extending linearly in the front-rear direction, and a blade-side curved side 34B which is curved in a substantially arc shape to be convex to the left side when seen from the axial direction of the cutwork blade 30. That is, the blade-side cutting side 34A is formed in a flat surface shape along a surface orthogonal to the left-right direction. Further, in the blade portion 34, the blade-side cutting side 34A mainly has a function of cutting the cutting target object 50. That is, the cutwork blade 30 is formed in a non-circular shape including at least a linear portion constituting the blade-side cutting side 34A in a plan sectional view.

Further, an inclined surface 34C is formed on the lower end portion of the blade-side curved side 34B of the blade portion 34. The lower end of the inclined surface 34C matches the lower end of the blade-side cutting side 34A, and the inclined surface 34C is inclined to the left side as going upward in a front view. That is, the lower end portion of the blade portion 34 is formed in a wedge shape in a front view.

Regarding Needle Plate 40

The needle plate 40 has a needle plate body 42 formed in a substantially rectangular plate shape of which the plate thickness direction is the up-down direction. The needle plate body 42 is detachably fixed to the upper portion of the bed portion 12C of the sewing machine body 12, and is arranged below the cutwork blade 30. The cutting target object 50 sandwiched by the embroidery frame 22 is placed above the needle plate 40 (refer to FIGS. 3A and 3B).

A needle plate hole 44 is formed to penetrate the needle plate body 42, and the needle plate hole 44 is arranged below the cutwork blade 30. When the needle bar 14 is lowered, the blade portion 34 of the cutwork blade 30 is inserted into the needle plate hole 44. The needle plate hole 44 is formed in a substantially D shape similar to that of the blade portion 34 of the cutwork blade 30, in a plan view. Specifically, the inner circumferential portion of the needle plate hole 44 is configured to include a hole-side cutting side 44A extending linearly in the front-rear direction, and a relief side 44B as a "relief portion" which is curved in a substantially arc shape to be convex to the left side, in a plan view. That is, the hole-side cutting side 44A is formed in a flat surface shape along a surface orthogonal to the left-right direction. In FIG. 2, a portion hatched and indicated by the two-dot chain line on the inner side of the needle plate hole 44 illustrates the projection of the blade portion 34 of the cutwork blade 30.

The size of the needle plate hole 44 is set to be greater than the size of the blade portion 34 of the cutwork blade 30. Further, in a plan view, the blade-side cutting side 34A of the blade portion 34 and the hole-side cutting side 44A of the needle plate hole 44 are arranged to face each other in the left-right direction. More specifically, when the blade portion 34 is inserted into the needle plate hole 44, the blade-side cutting side 34A and the hole-side cutting side 44A are arranged to face each other in the left-right direction in a state where there is a minute gap (state where there is almost no gap) between the blade-side cutting side 34A and the hole-side cutting side 44A (refer to FIG. 3B).

Further, the sizes of the blade portion 34 and the needle plate hole 44 are set such that a predetermined gap G1 is formed between the blade-side curved side 34B of the blade portion 34 and the relief side 44B of the needle plate hole 44 when the blade portion 34 is inserted into the needle plate hole 44. That is, the gap G1 between the blade-side curved side 34B and the relief side 44B is set to be constant in the circumferential direction of the blade-side curved side 34B (relief side 44B) in a plan view. The dimension of the gap G1 (distance between the blade-side curved side 34B and the relief side 44B) is set to be equal to or greater than the maximum thickness of the cutting target object 50 to be cut.

Action and Effect

In the sewing machine 10 configured as described above, the cutwork blade 30 is provided above the needle plate 40, and the cutwork blade 30 is fixed to the lower end portion of the needle bar 14 via the needle bar fixing portion 16. In addition, the needle plate hole 44 into which the blade portion 34 of the cutwork blade 30 is inserted is formed to penetrate the needle plate 40. The cutting target object 50 is placed above the needle plate 40, and the cutting target object 50 is cut when the cutwork blade 30 is lowered together with the needle bar 14.

Figure 3A:
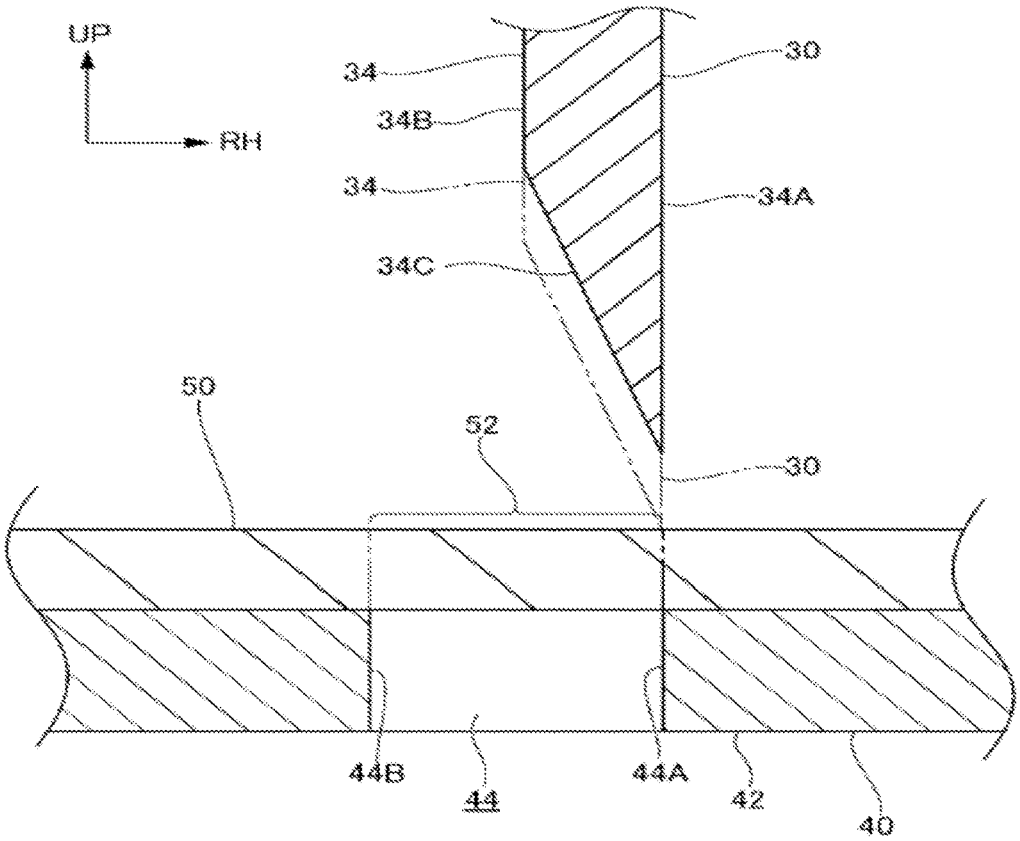
FIG. 3A is a sectional view schematically illustrating a state before a cutting target object is cut by the cutwork blade illustrated in FIG. 2, which is seen from the front side.

As illustrated in FIG. 3A, in a case where a portion of the cutting target object 50 which overlaps the needle plate hole 44 of the needle plate 40 in the up-down direction is set as a cut portion 52, at the start of cutting the cutting target object 50, the lower end of the blade portion 34 (blade-side cutting side 34A) comes into contact with the upper surface of the cut portion 52, and presses the cut portion 52 downward (refer to the blade portion 34 illustrated by two-dot chain line in FIG. 3A). Therefore, the cut portion 52 is pushed into the needle plate hole 44 by the lower end of the blade-side cutting side 34A.

Here, the hole-side cutting side 44A for cutting the cutting target object 50 together with the blade-side cutting side 34A of the cutwork blade 30 is formed in the needle plate hole 44. Specifically, in a plan view, the hole-side cutting side 44A is arranged to face the blade-side cutting side 34A of the blade portion 34 in the left-right direction. That is, when the blade portion 34 is inserted into the needle plate hole 44, the blade-side cutting side 34A and the hole-side cutting side 44A are arranged to face each other in the left-right direction in a state where there is almost no gap. Therefore, when the cutwork blade 30 (blade portion 34) is further lowered, shear force is generated in the cutting target object 50 by the blade-side cutting side 34A and the hole-side cutting side 44A, and a boundary portion between the cut portion 52 and the other portion of the cutting target object 50 is cut. That is, the cutting target object 50 is sheared and cut by the blade-side cutting side 34A and the hole-side cutting side 44A. As a result, a substantially linear cut surface 54 (refer to FIG. 3B) is formed in the cutting target object 50. In this case, the cut portion 52 is further pushed into the needle plate hole 44 by the blade portion 34.

Figure 3B:
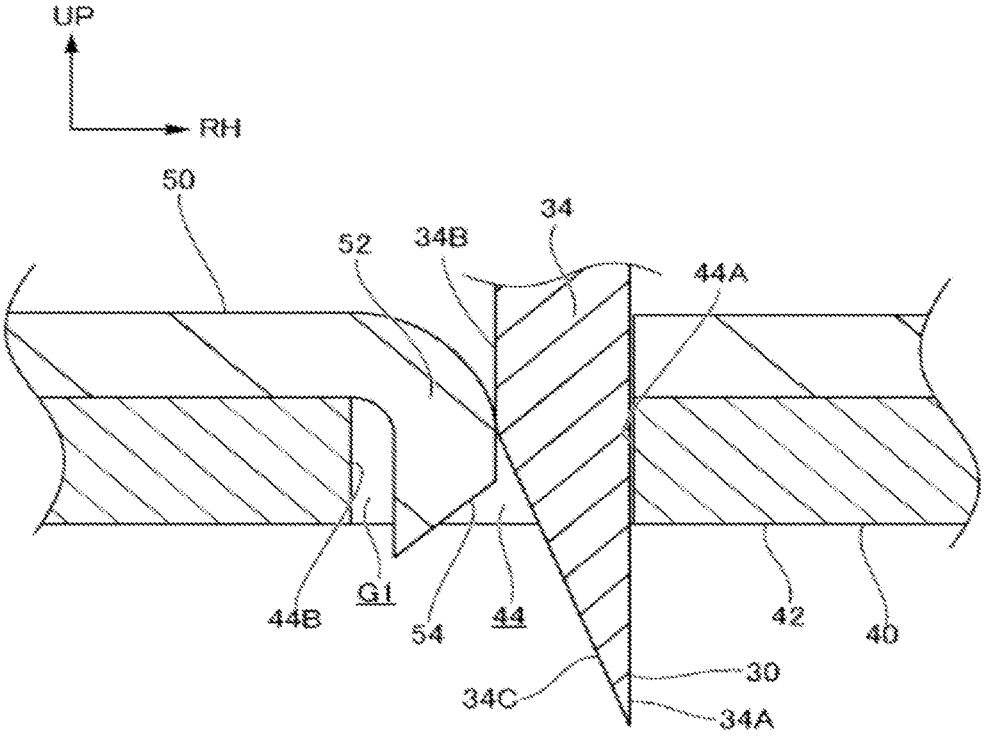
FIG. 3B is a sectional view schematically illustrating a state after a cutting target object is cut by lowering the cutwork blade in the state of FIG. 3A.

Here, the needle plate hole 44 has the relief side 44B for allowing the cut portion 52 of the cutting target object 50 to escape. Specifically, when the blade portion 34 is inserted into the needle plate hole 44, the gap G1 is formed between the blade portion 34 and the relief side 44B. Therefore, the cut portion 52 pushed into the needle plate hole 44 by the blade portion 34 is bent by the upper edge of the relief side 44B. In this manner, as illustrated in FIG. 3B, the cut portion 52 escapes into the gap G1 between the blade portion 34 and the relief side 44B. That is, after the cutting target object 50 is cut by the blade portion 34, the cut portion 52 escapes toward the relief side 44B, and the blade portion 34 and the cut portion 52 are arranged in the needle plate hole 44. In this manner, the cutwork on the cutting target object 50 by the cutwork blade 30 is finished.

Then, the embroidery frame drive device 20 is driven to move the cutting target object 50 relative to the needle plate 40 and the cutwork blade 30, and thereby the cutwork is performed a plurality of times on the cutting target object 50.

As described above, in the sewing machine 10 of the embodiment, the needle plate hole 44 of the needle plate 40 is configured to include the hole-side cutting side 44A for cutting the cutting target object 50 together with the blade portion 34, and the relief side 44B for allowing the cut portion 52 of the cutting target object 50 to escape. Specifically, the needle plate hole 44 has the hole-side cutting side 44A for shearing the cutting target object 50 together with the blade-side cutting side 34A of the blade portion 34, and the relief side 44B for forming the gap G1 between the blade portion 34 to be inserted and the relief side 44B. In this manner, as described above, in the former stage of the cutting processing on the cutting target object 50, the cutting target object 50 can be cut by the hole-side cutting side 44A and the blade portion 34 (blade-side cutting side 34A). Further, in the latter stage of the cutting processing on the cutting target object 50, the blade portion 34 and the cut portion 52 can be arranged in the needle plate hole 44 by allowing the cut portion 52, which is pushed into the needle plate hole 44 by the blade portion 34, to escape toward the relief side 44B. Accordingly, the finish of the cut portion 52 of the cutting target object 50 can be improved.

That is, in the sewing machine having a circular needle plate hole as described in the background art (hereinafter, this sewing machine is referred to as a "sewing machine in a comparative example"), the needle plate hole is configured not to include the hole-side cutting side 44A of the embodiment. In the sewing machine in the comparative example, when the blade portion 34 of the cutwork blade 30 is lowered so that the blade-side cutting side 34A presses the cutting target object 50 downward, the cutting target object 50 is pushed into the needle plate hole by the lower end of the cutwork blade 30 as described above. In this case, a predetermined gap is formed between the inner circumferential surface of the needle plate hole and the blade-side cutting side 34A of the blade portion 34 to be inserted. Therefore, it is difficult to perform cutting by shearing the cutting target object 50, and the cutting target object 50 pushed into the needle plate hole is pulled up and down by the upper edge of the needle plate hole and the lower end of the blade portion 34. When the blade portion 34 is further lowered, the cutting target object 50 is torn off to be cut at a portion in contact with the lower end of the blade portion 34. In this manner, in the sewing machine in the comparative example, the cut surface of the cutting target object 50 may be formed to be a rough surface.

Further, in the sewing machine in the comparative example, as described above, since the cutting target object 50 pushed into the needle plate hole is pulled up and down by the upper edge of the needle plate hole and the lower end of the blade portion 34, the cut portion 52 of the cutting target object 50 may be stretched.

On the other hand, in the sewing machine 10 of the embodiment, as described above, the needle plate hole 44 of the needle plate 40 is configured to include the hole-side cutting side 44A for performing cutting by shearing the cutting target object 50 together with the blade portion 34, and the relief side 44B for allowing the cut portion 52 of the cutting target object 50 to escape. That is, the needle plate hole 44 has two functions, a function of cutting the cutting target object 50 together with the blade portion 34 and a function of allowing the cut portion 52 after cutting to escape toward the relief side 44B. Therefore, the cutting target object 50 pushed by the blade portion 34 is cut by the blade portion 34 and the hole-side cutting side 44A, and the cut portion 52 which has been cut can satisfactorily escape toward the relief side 44B by the relief side 44B. In this manner, in the cutting target object 50, a portion to be cut can be clearly set and cut. Further, for example, the relief side 44B can suppress that the cut portion 52 pushed into the needle plate hole 44 by the blade portion 34 is pulled up by the blade portion 34 after the cutting target object 50 is cut. Accordingly, the finish of the cut portion 52 can be improved.

Further, in a plan view, the blade-side cutting side 34A of the blade portion 34 and the hole-side cutting side 44A of the needle plate hole 44 are formed in a flat surface shape extending linearly in the front-rear direction. As described above, in a plan view, the blade-side cutting side 34A and the hole-side cutting side 44A are arranged to face each other in the left-right direction. In this manner, the cutting target object 50 can be sheared and cut by the blade-side cutting side 34A and the hole-side cutting side 44A. In this manner, the finish of the cut surface 54 of the cut portion 52 can be improved.

In addition, the relief side 44B of the needle plate hole 44 is configured as a curved surface which is curved in an arc shape to be convex to the left side. That is, the needle plate hole 44 is formed in a D shape similar to the sectional shape of the blade portion 34 of the cutwork blade 30, in a plan view. In this manner, it is possible to satisfactorily allow the cut portion 52 extruded by the blade portion 34 to escape toward the relief side 44B when the blade portion 34 is inserted into the needle plate hole 44, while suppressing that the outer shape of the needle plate hole 44 becomes excessively large.

Second Embodiment

Figure 4:
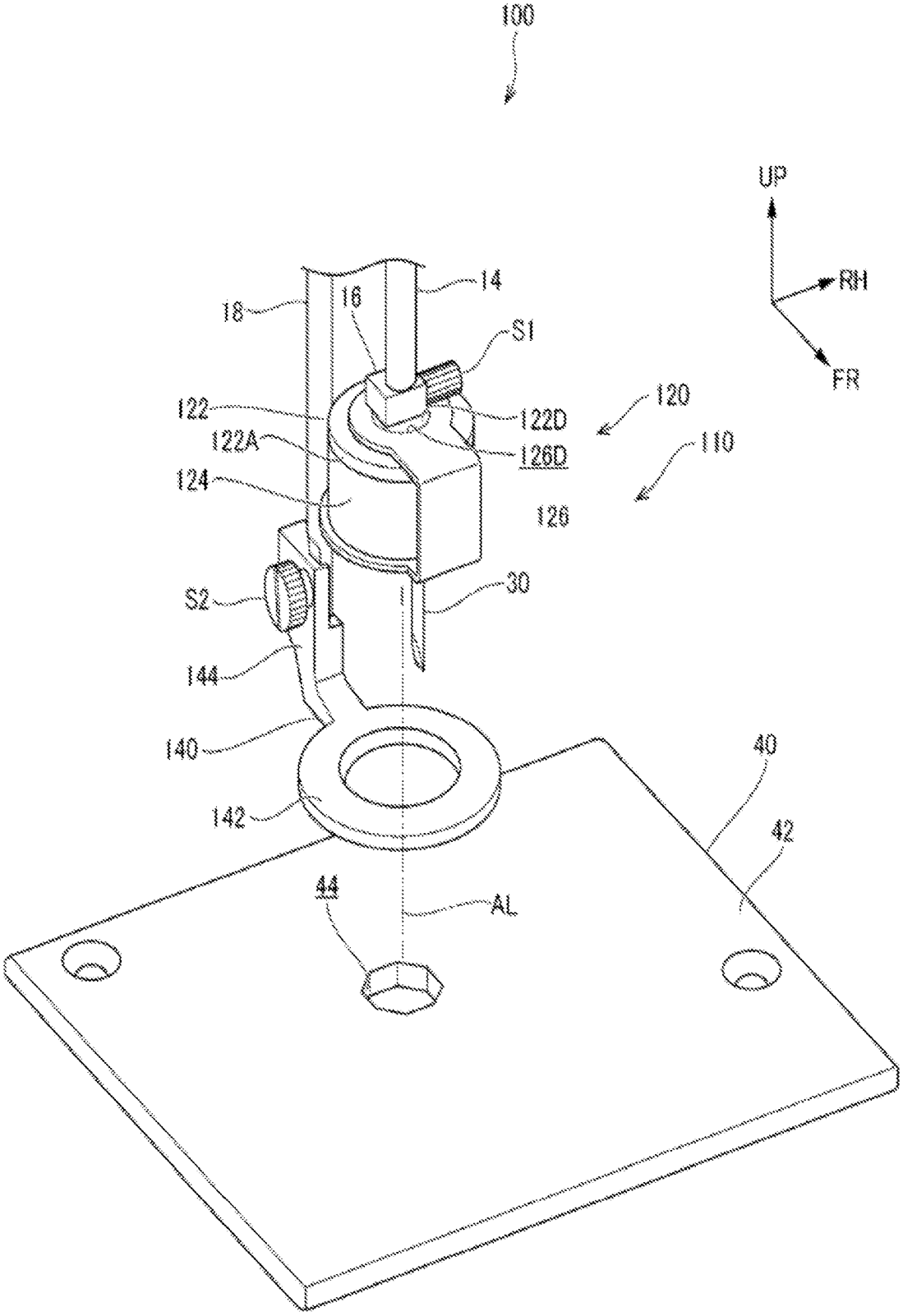
FIG. 4 is a perspective view illustrating a main part of a sewing machine to which a needle plate according to a second embodiment is applied, which is seen diagonally from the front left.
Figure 5:
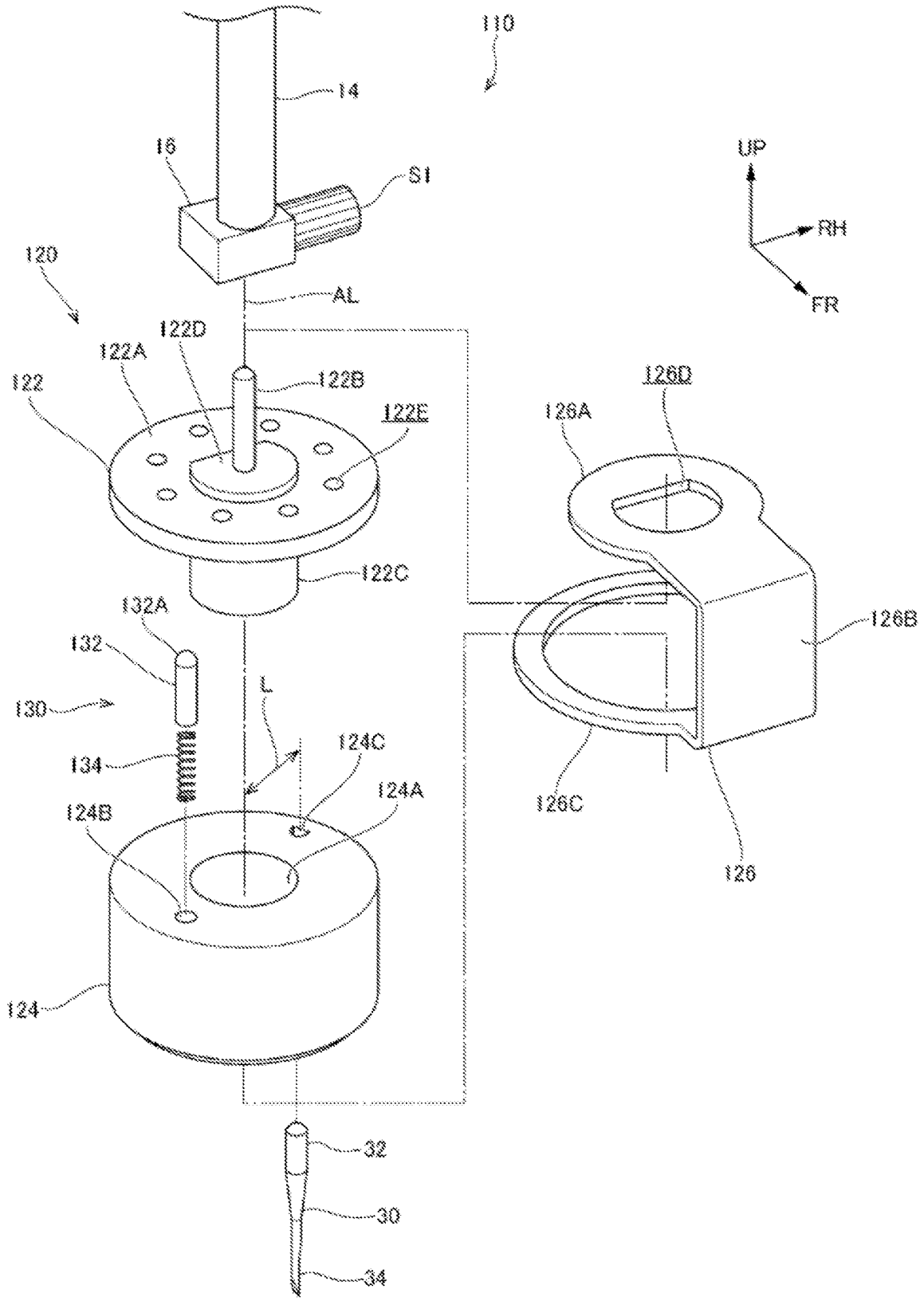
FIG. 5 is an exploded perspective view in which a cutwork mechanism illustrated in FIG. 4 is exploded.
Figure 6:
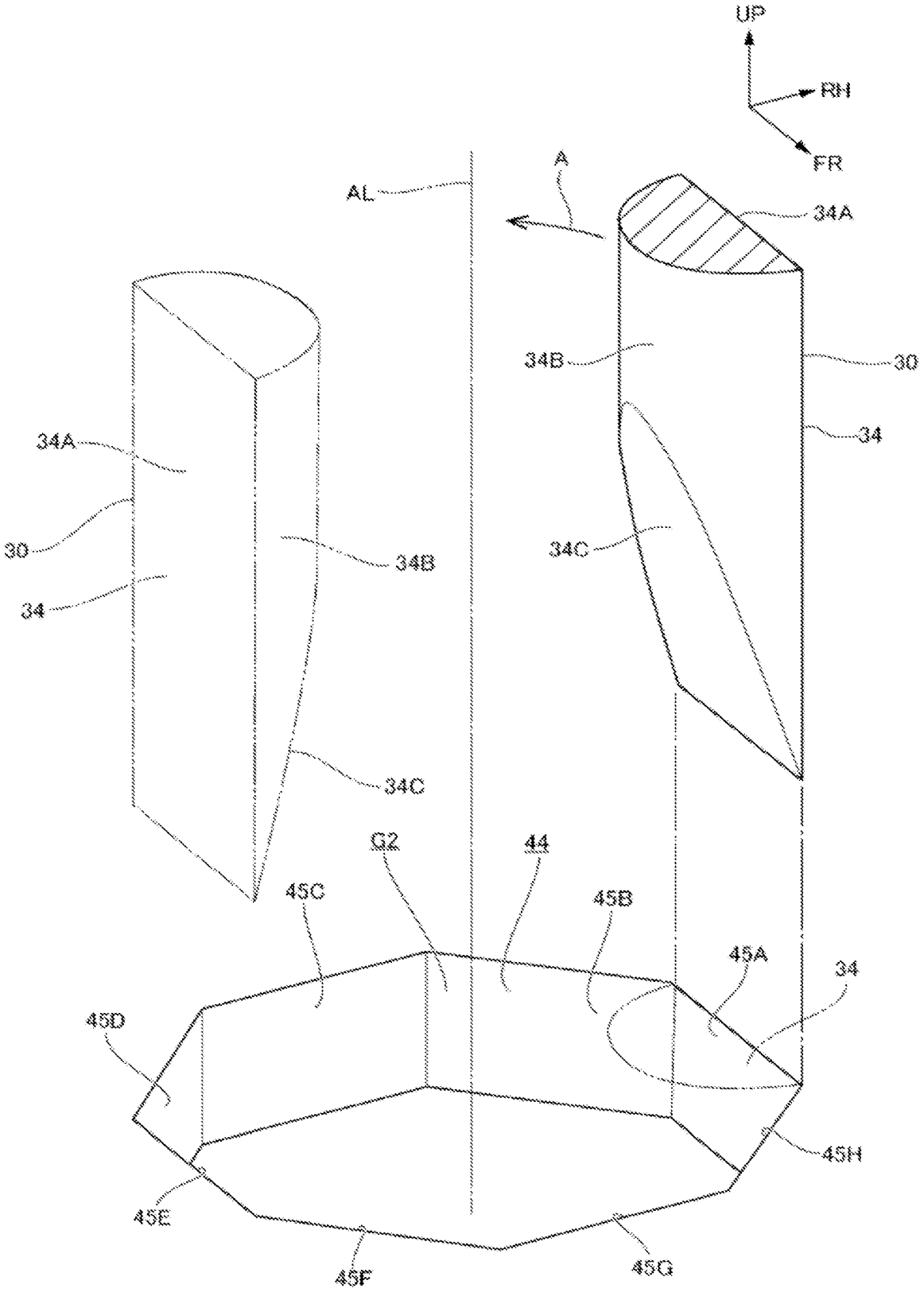
FIG. 6 is a perspective view illustrating a blade portion of a cutwork blade and a needle plate hole illustrated in FIG. 4 in an enlarged manner.

Next, a sewing machine 100 to which the needle plate according to a second embodiment is applied will be described using FIGS. 4 to 6. In FIGS. 4 to 6, the portions configured similar to the sewing machine 10 of the first embodiment are denoted by the same reference numerals.

That is, the sewing machine 100 has a cutwork mechanism 110 that rotatably connects the cutwork blade 30 to the needle bar 14 and holds the cutwork blade 30 at a predetermined rotation position. Hereinafter, each configuration of the sewing machine 100 will be described.

Regarding Cutwork Mechanism 110

As illustrated in FIGS. 4 and 5, the cutwork mechanism 110 is configured to include a rotation mechanism 120, and a lock mechanism 130.

Regarding Rotation Mechanism 120

The rotation mechanism 120 has a base 122, a rotation body 124, and a bracket 126.

The base 122 has a base plate 122A, and the base plate 122A is formed in a substantially disk shape of which the plate thickness direction is the up-down direction. A base fixing shaft 122B protruding upward is formed at a central portion of the base plate 122A, and the base fixing shaft 122B is formed in a substantially D shape in a plan view. The base fixing shaft 122B is mounted to the fixing hole of the needle bar fixing portion 16 from below, and is fixed to the needle bar fixing portion 16 by the fixing screw S1. In this manner, the base 122 is connected to the needle bar 14 so as not to be relatively movable.

The base 122 has a connection pillar 122C for connecting the rotation body 124 which will be described later. The connection pillar 122C is formed in a substantially columnar shape of which the axial direction is the up-down direction, extends downward from the base plate 122A, and is arranged coaxially with the needle bar 14.

A fitting portion 122D protruding upward is formed at a substantially central portion on the upper surface of the base plate 122A. The fitting portion 122D is formed in a substantially D shape in a plan view.

Further, a plurality of (8 in the embodiment) circular lock holes 122E are formed to penetrate the base plate 122A, on the outer side of the connection pillar 122C and the fitting portion 122D in a radial direction. The lock holes 122E are arranged on an imaginary circle centering on an axis line AL of the needle bar 14, and are arranged at equal intervals (every 45 degrees) around the axis line AL. The lock holes 122E constitute a part of the lock mechanism 130 which will be described later.

The rotation body 124 is formed in a substantially bottomed cylindrical shape which is open upward. Specifically, a connection recess 124A open upward is formed at the central portion of the rotation body 124, and the connection recess 124A is formed in a circular shape in a plan view. Then, the connection pillar 122C of the base 122 is inserted into the connection recess 124A from above, and the rotation body 124 is rotatably supported by the connection pillar 122C. That is, the rotation body 124 is arranged coaxially with the needle bar 14, and is connected to the base 122 so as to be rotatable around the axis line AL of the needle bar 14.

An accommodation recess 124B for accommodating a lock pin 132, which will be described later, is formed on the upper surface of the rotation body 124. The accommodation recess 124B is formed in a recess shape open upward, and is formed in a circular shape in a plan view. Further, in a plan view, the distance from the axis line AL to the accommodation recess 124B and the distance from the axis line AL to the lock hole 122E are the same. In this manner, the accommodation recess 124B and the lock hole 122E are configured to be arranged to face each other in the up-down direction, at a specific rotation position of the rotation body 124. The position of the rotation body 124 where the accommodation recess 124B and the lock hole 122E are arranged to face each other in the up-down direction is referred to as a lock position. That is, in the embodiment, 8 lock positions of the rotation body 124 are set around the axis line AL.

Further, a fixing hole 124C for fixing the cutwork blade 30 is formed to penetrate the rotation body 124 in the up-down direction. The fixing hole 124C is formed in a substantially D shape in a plan view, and is arranged 180 degrees apart from the accommodation recess 124B in the circumferential direction (rotation direction) of the rotation body 124.

The bracket 126 is formed in a substantially U-shaped plate shape open rearward, in a side view seen from the left-right direction. Specifically, the bracket 126 is configured to include an upper wall 126A, a front wall 126B extending downward from the front end portion of the upper wall 126A, and a lower wall 126C extending rearward from the lower end portion of the front wall 126B.

The upper wall 126A is arranged adjacent to the upper side of the base plate 122A of the base 122, and the lower wall 126C is arranged adjacent to the lower side of the rotation body 124 so that the base 122 and the rotation body 124 are sandwiched by the bracket 126 in the up-down direction. In this manner, the downward movement of the rotation body 124 is restricted by the bracket 126.

A fitting hole 126D is formed to penetrate the upper wall 126A. The fitting hole 126D is formed in a substantially D shape in a plan view, corresponding to the fitting portion 122D of the base 122. The fitting portion 122D is fitted into the fitting hole 126D. In this manner, the rotation of the bracket 126 around the axis line AL relative to the base 122 is restricted.

The lower wall 126C is formed in a substantially annular plate shape, and is arranged coaxially with the needle bar 14. The outer diameter of the lower wall 126C is set to be greater than the outer diameter of the rotation body 124. Further, the inner diameter of the lower wall 126C is set to be greater than a distance L from the axis line AL to the fixing hole 124C. That is, the fixing hole 124C is arranged inward of the lower wall 126C when seen from below.

Regarding Lock Mechanism 130

The lock mechanism 130 is configured as a mechanism that locks (prevents) the rotation of the rotation body 124. The lock mechanism 130 is configured to include the lock holes 122E formed on the base 122, the lock pin 132, and an urging spring 134.

The lock pin 132 is formed in a substantially columnar shape of which the axial direction is the up-down direction. The lock pin 132 is inserted into the accommodation recess 124B of the rotation body 124 so as to be relatively movable in the up-down direction. The upper end portion of the lock pin 132 is configured as an engaging portion 132A, and the engaging portion 132A is formed in a hemispherical shape that is convex upward. Further, the diameter of the lock pin 132 is set to be greater than the diameter of the lock hole 122E of the base 122.

The urging spring 134 is configured as a compression coil spring. The urging spring 134 is accommodated in the accommodation recess 124B together with the lock pin 132 in a state of being compressed and deformed. Specifically, the urging spring 134 is arranged below the lock pin 132, the lower end portion of the urging spring 134 is locked to the bottom surface of the accommodation recess 124B, and the upper end portion of the urging spring 134 is locked to the lower surface of the lock pin 132. In this manner, the lock pin 132 is urged upward by the urging spring 134.

At the lock position of the rotation body 124, the top of the engaging portion 132A of the lock pin 132 is arranged in the lock hole 122E, and the engaging portion 132A is in contact with the edge portion of the lock hole 122E, so that the lock pin 132 and the lock hole 122E are engaged with each other. In this manner, the rotation of the rotation body 124 is locked (prevented).

Further, at the lock position of the rotation body 124, the lock state of the rotation body 124 by the lock mechanism 130 is released by applying rotational force equal to or greater than a predetermined value to the rotation body 124. That is, by applying the rotational force equal to or greater than the predetermined value to the rotation body 124, the lock pin 132 is moved downward against the urging force of the urging spring 134, and thereby the engaged state between the lock pin 132 and the lock hole 122E is released. Then, the lock pin 132 is engaged with the lock hole 122E again by relatively rotating the rotation body 124 to the next lock position, and thereby the rotation body 124 returns to the lock state by the lock mechanism 130. That is, the rotation body 124 is configured to be locked at every predetermined rotation angle (45 degrees in the embodiment) by the lock mechanism 130.

The blade-side fixing portion 32 of the cutwork blade 30 is fitted into the fixing hole 124C of the rotation body 124 from below, so that the cutwork blade 30 is fixed to the rotation body 124. In this manner, in a state where the rotation of the cutwork blade 30 relative to the rotation body 124 is restricted, the cutwork blade is arranged at a position apart (eccentric) from the axis line AL by the distance L in a plan view. That is, the cutwork blade 30 is configured to be rotated around the axis line AL at a position eccentric with respect to the axis line AL by the rotating the rotation body 124 around the axis line AL.

In this manner, in the second embodiment, the cutwork blade 30 is held at every predetermined rotation angle (every 45 degrees) around the axis line AL by the cutwork mechanism 110, and the position and direction of the cutwork blade 30 relative to the needle plate 40 are changed. Specifically, in an initial state of the cutwork mechanism 110, the cutwork blade 30 is held at an initial position (position indicated by the solid line in FIG. 6), and for example, in a case where the cutwork blade 30 is rotated by 180 degrees to one side (direction of an arrow A in FIG. 6) of the rotation direction from the initial position, the cutwork blade 30 is arranged at a position indicated by the two-dot chain line in FIG. 6. At the initial position, the cutwork blade 30 is arranged such that the blade-side cutting side 34A of the cutwork blade 30 extends in the front-rear direction and the blade-side curved side 34B is convex to the left side (toward the axis line AL with respect to the blade-side cutting side 34A) in a plan view.

Further, as illustrated in FIG. 6, in the second embodiment, the needle plate hole 44 of the needle plate 40 is formed in a regular octagonal shape centering on the axis line AL. That is, the set number of holding positions of the cutwork blade 30 and the number of sides of the needle plate hole 44 are the same. The sides of the needle plate hole 44 are configured as a first hole side 45A, a second hole side 45B, a third hole side 45C, a fourth hole side 45D, a fifth hole side 45E, a sixth hole side 45F, a seventh hole side 45G, and an eighth hole side 45H, and the length of each of the first to eighth hole sides 45A to 45H is the same as the length of the blade-side cutting side 34A of the cutwork blade 30 when seen from below.

At the holding position of the cutwork blade 30, in a plan view, the cutwork blade 30 is arranged in the needle plate hole 44, and the blade-side cutting side 34A of the cutwork blade 30 is arranged to face any one of the first to eighth hole sides 45A to 45H. Specifically, the blade-side cutting side 34A of the cutwork blade 30 at the initial position is arranged to face the first hole side 45A in the left-right direction in a state where there is almost no gap. That is, in the second embodiment, each time the cutwork blade 30 is held at every predetermined rotation angle by being rotated to one side in the rotation direction from the initial position, the side of the needle plate hole 44 that is arranged to face the blade-side cutting side 34A is changed from the first hole side 45A to the side of the needle plate hole 44 adjacent to one side in the rotation direction. That is, the sides of the needle plate hole 44 and the cutwork blade 30 held at respective holding positions have a one-to-one correspondence.

In this manner, in the second embodiment, in a plan view, the side of the needle plate hole 44 that is arranged to face the blade-side cutting side 34A of the cutwork blade 30 corresponds to the "hole-side cutting side" in the invention, and the sides of the needle plate hole 44 that are not arranged to face the blade-side cutting side 34A of the cutwork blade 30 correspond to the "relief portion" in the invention. For example, in a state where the cutwork blade 30 is held at the initial position, the first hole side 45A corresponds to the "hole-side cutting side" in the invention, and the second to eighth hole sides 45B to 45H correspond to the "relief portion" in the invention. For example, in a state where the cutwork blade 30 is held at a position rotated 180 degrees to one side in the rotation direction from the initial position, the fifth hole side 45E corresponds to the "hole-side cutting side" in the invention, and the first to fourth hole sides 45A to 45D and the sixth to eighth hole sides 45F to 45H correspond to the "relief portion" in the invention. That is, each time the cutwork blade 30 is rotated and held around the axis line AL, in the needle plate hole 44, the side corresponding to the "hole-side cutting side" is changed.

In a plan view, a gap G2 is formed between the needle plate hole 44 and the blade-side curved side 34B of the cutwork blade 30. The gap G2 is set to be equal to or greater than the maximum thickness of the cutting target object 50, similar to the first embodiment.

As illustrated in FIG. 4, a presser bar 18 is provided in the arm portion 12B (not illustrated in FIG. 4) to be behind the needle bar 14. The presser bar 18 is formed in a columnar shape extending in the up-down direction, and the lower end portion of the presser bar 18 protrudes downward from the arm portion 12B. The presser bar 18 is supported by an operation lever (not illustrated), and is configured to be moved in the up-down direction by operating the operation lever.

Further, a presser 140 is provided on the lower end portion of the presser bar 18. The presser 140 is configured to include a presser plate portion 142, and a presser fixing portion 144. The presser plate portion 142 is formed in a substantially annular plate shape of which the plate thickness direction is the up-down direction, and is arranged coaxially with the needle bar 14, on a side below the cutwork mechanism 110. The presser fixing portion 144 is formed in a substantially L-shaped block shape when seen from the left side, and the lower end portion of the presser fixing portion 144 is connected to the rear end portion of the presser plate portion 142. The upper end portion of the presser fixing portion 144 is fixed to the lower end portion of the presser bar 18 by a fixing screw S2. The presser 140 is moved downward together with the presser bar 18 by operating the operation lever (not illustrated) so as to press the cutting target object 50 from above.

The inner diameter of the presser plate portion 142 is set such that the cutwork blade 30 is inserted through the presser plate portion 142 when the cutwork blade 30 is lowered together with the needle bar 14.

As described above, in the sewing machine 100 of the second embodiment, the base 122 is attached to the lower end portion of the needle bar 14, and the rotation body 124 is connected to the base 122 to be rotatable around the axis line AL of the needle bar 14. The rotation body 124 is provided with the cutwork blade 30, and the cutwork blade 30 extends downward from the rotation body 124 at a position eccentric from the axis line AL by the distance L, and is arranged at the initial position. The rotation of the rotation body 124 is restricted at the lock position by the lock mechanism 130. In this manner, the cutwork blade 30 is held at every predetermined rotation angle (45 degrees) around the axis line AL.

In the needle plate 40, the needle plate hole 44 into which the blade portion 34 of the cutwork blade 30 is inserted is formed, and the needle plate hole 44 is formed in a regular octagonal shape centering on the axis line AL. Specifically, in a plan view, the cutwork blade 30 is arranged in the needle plate hole 44, and the first hole side 45A of the needle plate hole 44 is arranged to face the blade-side cutting side 34A of the cutwork blade 30 at the initial position. Further, the gap G2 is formed between the second to eighth hole sides 45B to 45H of the needle plate hole 44 and the blade-side curved side 34B of the cutwork blade 30.

In this manner, in the second embodiment, the needle plate hole 44 of the needle plate 40 is configured to include the first hole side 45A for cutting the cutting target object 50 together with the blade portion 34 (blade-side cutting side 34A), and the second to eighth hole sides 45B to 45H for allowing the cut portion 52 of the cutting target object 50 to escape. In this manner, similar to the first embodiment, when the cutwork blade 30 is lowered, in the former stage of the cutting processing on the cutting target object 50, the cutting target object 50 can be cut by the first hole side 45A and the blade portion 34 (blade-side cutting side 34A). Further, in the latter stage of the cutting processing on the cutting target object 50, the blade portion 34 and the cut portion 52 can be arranged in the needle plate hole 44 by allowing the cut portion 52, which is pushed into the needle plate hole 44 by the blade portion 34, to escape toward the second to eighth hole sides 45B to 45H. Accordingly, similar to the first embodiment, the finish of the cut portion 52 of the cutting target object 50 can be improved.

In the second embodiment, the cutwork blade 30 is configured to be rotatable around the axis line AL of the needle bar 14 by the cutwork mechanism 110, and is held at every predetermined rotation angle (every 45 degrees). The needle plate hole 44 is formed in a regular octagonal shape centering on the axis line AL of the needle bar 14. That is, the number of sides of the needle plate hole 44 and the set number of positions where the cutwork blade 30 is held are the same. Further, the length of each of the first to eighth hole sides 45A to 45H constituting the sides of the needle plate hole 44 is the same as the length of the blade-side cutting side 34A of the cutwork blade 30. In a plan view, the cutwork blade 30 is arranged in the needle plate hole 44, and the first hole side 45A is arranged to face the blade-side cutting side 34A of the cutwork blade 30.

In this manner, even in a case where the cutwork blade 30 is held at the second to eighth positions, in a plan view, the second to eighth hole sides 45B to 45H are arranged to face the blade-side cutting side 34A of the cutwork blade 30, and the gap G2 is formed between the cutwork blade 30 and the needle plate hole 44. In this manner, even at the second to eighth positions of the cutwork blade 30, the cutting target object 50 can be sheared to be cut by the blade-side cutting side 34A and the needle plate hole 44, and the cut portion 52 pushed into the needle plate hole 44 by the blade portion 34 can escape by the gap G2, and the blade portion 34 and the cut portion 52 can be arranged in the needle plate hole 44. Accordingly, even in a case where the cutwork blade 30 is configured to be rotatable, the finish of the cut portion 52 of the cutting target object 50 can be improved.

The first and second embodiments can be variously omitted, replaced, and changed without departing from the scope of the invention, and the modifications thereof are also included in the invention.

What is claimed is:

1. A cutwork mechanism of a sewing machine, the cutwork mechanism comprising:

a needle plate body provided below a needle bar that is moved up and down; and a needle plate hole which is formed in the needle plate body, and into which a blade portion of a cutwork blade attached to a lower end portion of the needle bar is inserted, wherein:

the needle plate hole includes a hole-side cutting side which cuts a cutting target object together with the blade portion, and a relief portion which allows the cutting target object that has been cut to escape;

the blade portion has a blade-side cutting side that cuts the cutting target object together with the hole-side cutting side;

the needle plate hole has a regular polygonal shape configured by a plurality of sides, one of the sides being formed to fit the blade-side cutting side;

the hole-side cutting side is configured by one side of the needle plate hole;

the relief portion is configured by remaining sides of the plurality of sides of the needle plate hole; and the blade portion is rotated around an axis extending through a center of the regular polygon shape.

2. The cutwork mechanism according to claim 1, wherein, when the blade portion is inserted into the needle plate hole, a gap through which the cutting target object is able to pass is formed by the cutwork blade and the relief portion.

3. The cutwork mechanism according to claim 1, wherein the blade-side cutting side is formed linearly along the hole-side cutting side when seen from an axial direction of the needle bar, and the hole-side cutting side has a linear shape corresponding to the blade-side cutting side.

4. A sewing machine comprising a cutwork mechanism, wherein:

the cutwork mechanism includes a needle plate body provided below a needle bar that is moved up and down; and a needle plate hole which is formed in the needle plate body, and into which a blade portion of a cutwork blade attached to a lower end portion of the needle bar is inserted, and wherein:

the needle plate hole includes a hole-side cutting side which cuts a cutting target object together with the blade portion, and a relief portion which allows the cutting target object that has been cut to escape;

the blade portion has a blade-side cutting side that cuts the cutting target object together with the hole-side cutting side;

the needle plate hole has a regular polygonal shape configured by a plurality of sides, one of the sides being formed to fit the blade-side cutting side;

the hole-side cutting side is configured by one side of the needle plate hole;

the relief portion is configured by remaining sides of the plurality of sides of the needle plate hole; and the blade portion is rotated around an axis extending through a center of the regular polygon shape.

* * * * *